US012227342B2

(12) United States Patent
Gimström et al.

(10) Patent No.: US 12,227,342 B2
(45) Date of Patent: Feb. 18, 2025

(54) SIDEWALL SUPPORT INSERT

(71) Applicant: ESAB AB, Gothenburg (SE)

(72) Inventors: Claes Gimström, Gothenburg (SE); Gerard F. Klaes, Moab, UT (US); Hubert Kalicki, Kepa (PL); Joel Hyung-Kon Kim, Gothenburg (SE); Roberto Carlos Guerrero Kees, Frisco, TX (US); Rodolfo F. Rep, Hanover, PA (US)

(73) Assignee: ESAB AB, Gothenburg (SE)

( * ) Notice: Subject to any disclaimer, the term of this patent is extended or adjusted under 35 U.S.C. 154(b) by 113 days.

(21) Appl. No.: 17/951,925

(22) Filed: Sep. 23, 2022

(65) Prior Publication Data

US 2023/0119047 A1 Apr. 20, 2023

Related U.S. Application Data

(60) Provisional application No. 63/251,882, filed on Oct. 4, 2021.

(51) Int. Cl.
*B65D 5/46* (2006.01)
*B65D 5/42* (2006.01)

(52) U.S. Cl.
CPC ..... *B65D 5/46008* (2013.01); *B65D 5/4208* (2013.01)

(58) Field of Classification Search
CPC .. B65D 5/46008; B65D 5/4208; B65D 19/06; B65D 85/04; B65D 2519/00159; B65D 2519/00452; B65D 2519/00497; B65D 2519/00786; B65D 25/22
See application file for complete search history.

(56) References Cited

U.S. PATENT DOCUMENTS

| | | | | |
|---|---|---|---|---|
| 3,157,342 | A | 11/1964 | Grady | |
| 5,193,701 | A * | 3/1993 | Bush | B65D 9/24 229/164 |
| 5,199,243 | A | 4/1993 | Vlasaty et al. | |
| 5,462,221 | A * | 10/1995 | Zink | B65D 5/0055 229/199 |
| 6,619,540 | B1 | 9/2003 | Bazany | |
| 7,278,545 | B2 | 10/2007 | Costin et al. | |
| 8,967,690 | B2 | 3/2015 | Cooper et al. | |
| D735,556 | S | 8/2015 | Cooper et al. | |
| 9,265,307 | B2 | 2/2016 | Cooper et al. | |
| 10,858,173 | B2 | 12/2020 | Song et al. | |

(Continued)

FOREIGN PATENT DOCUMENTS

EP 3533552 9/2019

OTHER PUBLICATIONS

Notification of Transmittal of the International Search Report and Written Opinion for International Patent Application No. PCT/IB2022/059465 dated Mar. 30, 2023, 13 pages.

*Primary Examiner* — Kareen K Thomas
(74) *Attorney, Agent, or Firm* — Edell, Shapiro & Finnan, LLC

(57) ABSTRACT

A system and method for reinforcing a sidewall of a carrier with an insert is disclosed. The insert includes a plate having a front face and a rear face opposite the front face, the plate defining an opening extending between the front face and the rear face. An oblique tab extends from the front face in a first direction, and a flange extends from the plate in a second direction.

15 Claims, 7 Drawing Sheets

(56) References Cited

U.S. PATENT DOCUMENTS

| | | | | |
|---|---|---|---|---|
| 10,899,495 | B2 | 1/2021 | Kim et al. | |
| 2004/0007612 | A1 | 1/2004 | Johanson et al. | |
| 2007/0194019 | A1* | 8/2007 | Seagle | B65D 19/18 340/572.1 |
| 2010/0213088 | A1* | 8/2010 | Goda | B65D 19/06 206/386 |
| 2013/0341381 | A1 | 12/2013 | Thomason et al. | |
| 2014/0215765 | A1 | 8/2014 | Cooper et al. | |
| 2017/0050756 | A1* | 2/2017 | Hill | B65D 77/067 |
| 2017/0259953 | A1* | 9/2017 | Bressan | B65D 5/4208 |
| 2019/0263555 | A1* | 8/2019 | Kim | B65D 5/64 |
| 2019/0263585 | A1 | 8/2019 | Song et al. | |

* cited by examiner

FIG.1C
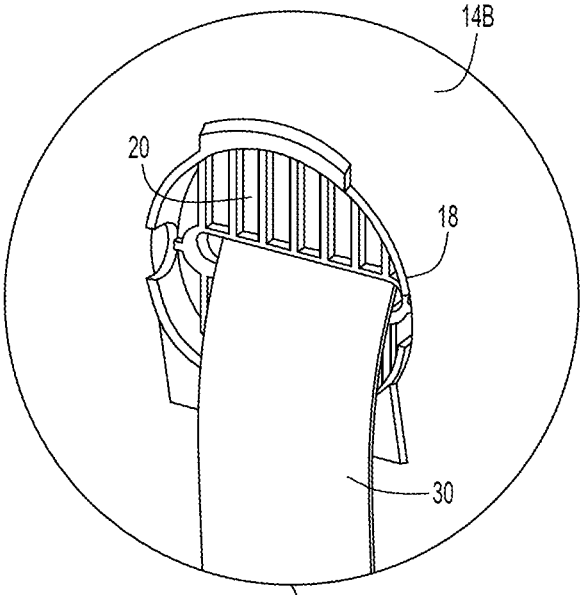
FIG.1D
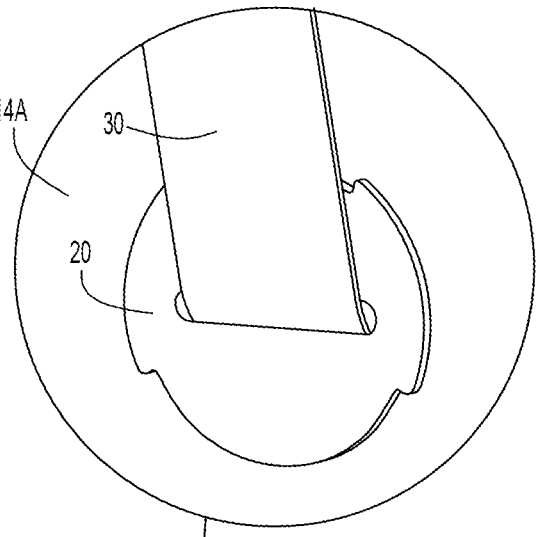
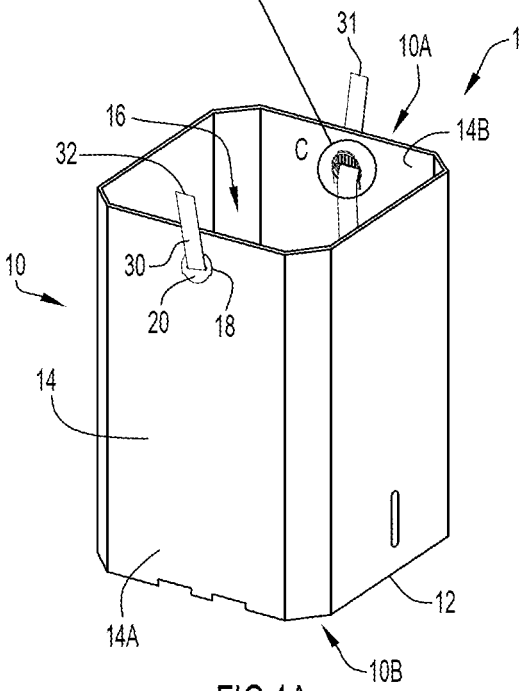
FIG.1A
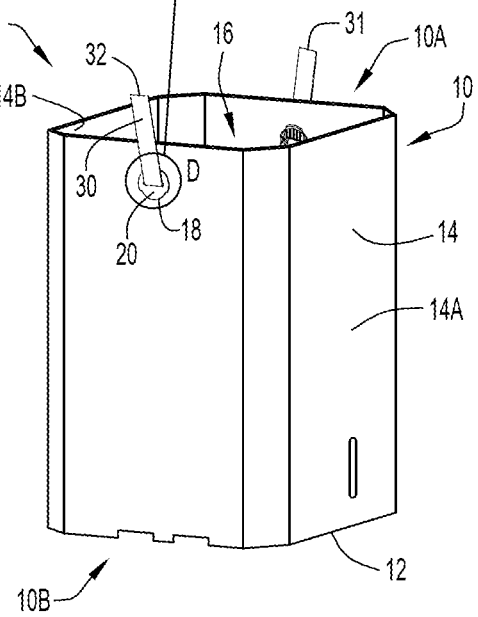
FIG.1B

SIDEWALL SUPPORT INSERT

PRIORITY CLAIM

This application claims priority to U.S. Provisional Application No. 63/251,882, filed Oct. 4, 2021. The entirety of this application is incorporated herein by reference.

FIELD OF INVENTION

The present invention relates to the field of bulk containers and, in particular, a reinforcement sidewall support insert for receiving a lifting strap.

BACKGROUND

Generally, bulk materials (e.g., bulk welding wire coils) are transported to a work site via a bulk carrier or container. The container is typically constructed from cardboard. The carrier with the bulk materials may be too heavy to lift by hand. Mechanical equipment is typically used to transport the carrier (and material) to the work site. For example, a forklift may engage and lift the carrier via a pallet at the base. In some implementations, the carrier may include a strap extending up from the carrier. The lifting equipment may engage the strap above the carrier to lift and transport the container with bulk material.

SUMMARY

The present invention relates to a sidewall support insert for a bulk carrier. In accordance with at least one embodiment of the present invention, the insert includes a plate having a front face and a rear face opposite the front face, the plate defining an opening extending between the front face and the rear face; at least one flange extending laterally from the front face; a sidewall extending perpendicularly from the rear face; and a stabilizing tab extending from the sidewall at an angle oblique to the front face.

According to an embodiment, the insert includes a plate having a front face and a rear face opposite the front face. The plate defines an opening extending between the front face and the rear face. The insert further includes a flange extending from the plate, a sidewall extending perpendicularly from the rear face, and a stabilizing tab extending from the sidewall at an angle oblique to the front face. In one form of the insert, the oblique angle is about 7 degrees.

In one form of the insert, the insert further includes a boss surrounding the opening. The boss is defined by a bottom wall, a top wall, and rounded sidewalls connecting the bottom wall and the top wall. The boss may define the opening between the front face and the rear face.

In some instances, the sidewall further includes a plurality of horizontally aligned cutouts configured to reduce an amount of force required to bend the insert.

In some embodiments, the sidewall extends around a perimeter of the plate.

In another form of the insert, the insert further includes a plurality of parallel reinforcing ribs disposed on the rear face.

In one aspect of the insert, the insert further includes a top tab opposite the stabilizing tab.

According to another embodiment, a method includes applying a torque to an insert until the insert bends about an axis, disposing the insert into a through-hole disposed within a sidewall of a carrier, releasing the torque applied to the insert such that the insert returns to a substantially equilibrium state and engages the sidewall, applying a first force to the sidewall via a tab extending obliquely from the insert, applying a second force opposite the first force to the sidewall via at least one flange extending from a front face of the insert, and threading a strap from an interior of the carrier, through an opening of the insert, to an exterior of the carrier and the insert.

In one form of the method, the tab applies the first force to an interior surface of the sidewall. The at least one flange may apply the second force to an exterior surface of the sidewall.

In some instances, the method further includes applying, via the strap, a third force to an interior side of the insert and a fourth force to an exterior side of the insert. The method may further include distributing the third force and the fourth force to the sidewall via the tab and the at least one flange.

According to yet another embodiment, a system includes a carrier having a plurality of sidewalls, at least one through-hole disposed in at least one sidewall of the plurality of sidewalls, and an insert disposed in the at least one through-hole. The insert includes a plate having a front face and a rear face opposite the front face, the plate defining an opening extending between the front face and the rear face; at least one flange extending from the plate; a sidewall extending perpendicularly from the rear face; and a stabilizing tab extending from the sidewall at an angle oblique to the front face.

In one form of the system, the stabilizing tab is configured to apply a first force to an interior surface of the at least one sidewall. The at least one flange may be configured to apply a second force to an exterior surface of the at least one sidewall.

In some instances, the oblique angle is between 5 and 10 degrees.

In some embodiments of the system, the sidewall extends around a perimeter of the plate. The sidewall may further include a plurality of horizontally aligned cutouts configured to reduce a bending moment of the insert.

In one form of the system, the system further includes a boss defining the opening, the boss comprising a bottom wall, a top wall, and rounded sidewalls connecting the bottom wall and the top wall.

According to yet another embodiment, an insert includes a plate having a front face and a rear face opposite the front face, an oblique tab extending from the front face in a first direction; and a flange extending radially from the plate in a second direction. The plate defines an opening extending between the front face and the rear face.

In some instances, an angle between the oblique tab and the front face is between 5 and 10 degrees.

In one form, the insert further includes a boss surrounding the opening, the boss being defined by a bottom wall, a top wall, and rounded sidewalls connecting the bottom wall and the top wall. The boss may define the opening between the front face and the rear face.

In some instances, the insert further includes a sidewall extending around a perimeter of the plate and between the plate and the flange.

In some embodiments, the insert further includes a plurality of parallel reinforcing ribs disposed on the rear face.

In one form, the insert further includes a second tab extending from a portion of the flange at a position that is opposite the oblique tab.

In one aspect, the opening is disposed in a top half of the plate proximate to the tab.

According to another embodiment, a method includes applying a stabilizing force from a tab of an insert to a first surface of a container; and applying, via a flange, a counter force to a second surface of the container that is opposite the first surface, the counter force and the stabilizing force being in opposing directions. The stabilizing force and the counter force maintain the insert within a through-hole of the container.

In some embodiments of the method, the insert includes a plate having a front face, a rear face opposite the front face, and an opening extending between the front face and the rear face that is defined by a boss. The tab may extend from a top end of the front face at an angle oblique to the front face. The method may further include inserting a lifting strap through the opening of the insert; and applying a first force and a second force to the boss of the insert via the lifting strap. The stabilizing force from the tab may oppose the first force, and wherein the counter force from the flange may oppose the second force. The first surface of the container may be an outer surface of the container. The stabilizing force may be applied to the outer surface of the container at a location disposed above the through-hole of the container.

According to yet another embodiment, a system includes a carrier having a plurality of sidewalls; at least one through-hole disposed in at least one sidewall of the plurality of sidewalls; and an insert disposed in the at least one through-hole. The insert includes a plate having a front face and a rear face opposite the front face, an oblique tab extending from the front face in a first direction; and at least one flange extending radially from the plate in a second direction. The plate defines an opening extending between the front face and the rear face.

In one form of the system, the oblique tab is configured to apply a first force to a first surface of the at least one sidewall. The at least one flange may be configured to apply a second force to a second surface of the at least one sidewall, the second surface being opposite the first surface.

In some instances, an angle between the oblique tab and the front face is between 5 and 10 degrees.

In some embodiments of the system, the plate further includes a sidewall extending along a perimeter of the plate between the front face of the plate and the at least one flange.

In one form of the system, the plate further includes a boss defining the opening, the boss comprising a bottom wall, a top wall, and rounded sidewalls connecting the bottom wall and the top wall.

In some instances, the opening is disposed in a top half of the plate proximate to the oblique tab.

BRIEF DESCRIPTION OF THE DRAWINGS

To complete the description and in order to provide for a better understanding of the present invention, a set of drawings is provided. The drawings form an integral part of the description and illustrate an embodiment of the present invention, which should not be interpreted as restricting the scope of the invention, but just as an example of how the invention can be carried out. The drawings comprise the following figures:

FIGS. 1A and 1B are side perspective views of a bulk carrier, according to an exemplary embodiment.

FIG. 1C is an enlarged view of an insert shown in reference circle C of FIG. 1A.

FIG. 1D is an enlarged view of an insert shown in reference circle D of FIG. 1B.

DETAILED DESCRIPTION

Figure 2A:
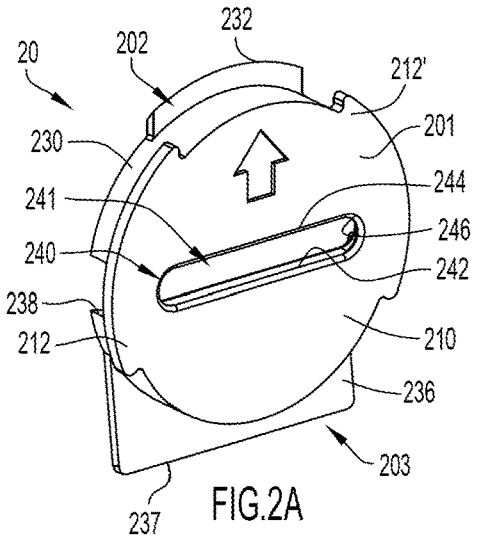
FIG. 2A is a front perspective view of an insert according to an exemplary embodiment.
Figure 2B:
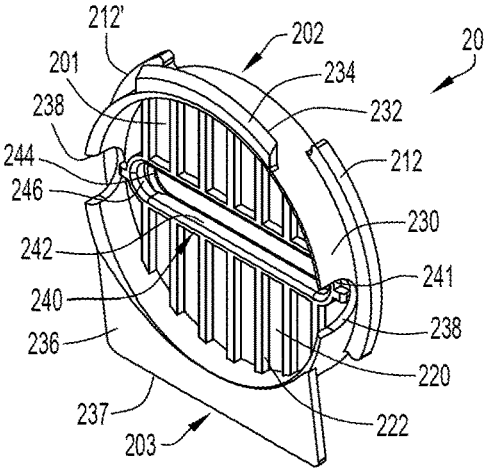
FIG. 2B is a rear perspective view of the insert of FIG. 2A.

The following description is not to be taken in a limiting sense but is given solely for the purpose of describing the broad principles of the invention. Embodiments of the invention will be described by way of example, with reference to the above-mentioned drawings showing elements and results according to the present invention.

Generally, transporting a heavy bulk carrier via a lifting strap may cause a container of the carrier to rip if mishandled, resulting in the release of and/or damage to the bulk material from the carrier. The container may be a corrugated cardboard box having a base and sidewalls that each have an outer surface and an inner surface. The base and sidewalls may define a cavity for receiving the contents (e.g., bulk material). The lifting strap may attach to the base and may extend between the outer surface of at least one sidewall and the contents, e.g., a coil of weld wire, placed in the container. Thus, the strap may surround and support the contents. As the strap extends towards a top of the carrier, the strap may extend through an opening, or through-hole, to an exterior of the sidewall. During transportation, if the carrier becomes unstable (e.g., due to mishandling resulting in swinging or tilting) while hanging above a support surface via the strap, the container may rip, tear, or otherwise come apart. For example, due to mishandling, the strap may kink, deform, and/or move with reference to the opening such that the lifting force unevenly distributes along the strap, and thus, the portion of the sidewall defining the opening. That is, the force applied by the strap to a portion of the sidewall contacting the strap may overcome the maximum stress/strain capacity of the container due to the mishandling. Consequently, the container may tear and spill or release contents received therein.

In view of at least the aforementioned issues, a sidewall support insert for reinforcing the sidewall at the opening and maintaining the orientation of the strap during operation is desirable.

FIGS. 1A-1D illustrate an exemplary embodiment of a carrier system 1 for transporting contents (e.g., a spool or coil of weld wire). The carrier system 1 includes a container 10, an insert 20, and a strap 30 having a first end 31 and a second end 32. The container 10 includes a base 12 and a plurality of sidewalls 14 and 14' extending perpendicularly from a perimeter of the base 12. Each sidewall 14 and 14' includes an exterior/outer surface 14A and an interior/inner surface 14B. The base 12 and the interior surfaces 14B define a cavity for receiving contents of the carrier system 1. Two opposing sidewalls 14 may each contain an opening, or through-hole, 18 extending from the interior surface 14B to the exterior surface 14A. That is, each opening 18 extends between the exterior and interior surfaces 14A and 14B of the sidewall 14. The openings 18 are disposed towards a top end 10A of the container 10, opposite the base 12 at a bottom end 10B. The openings 18 are configured to receive the insert 20. In the illustrated embodiment, the openings 18 are circles to reduce the stress along the portions of the sidewall 14 defining the openings 18. That is, the circular shape of the openings 18 evenly distributes forces applied to the sidewalls 14. In some implementations, the openings 18 may be circular, oval, square, rectangular, trapezoidal, pentagonal, hexagonal, heptagonal, octagonal, or other polygonal shape.

As shown in FIGS. 1A and 1B, the container 10 has a generally rectangular shape with beveled corners. Said another way, the container 10 has eight sidewalls 14 and 14' extending from the base 12 that form an irregular octagon, where some sidewalls 14 are wider than other sidewalls 14'. However, the container 10 may have any number of sidewalls 14 and 14' each with any desired width.

Now referring to FIGS. 1C and 1D, enlarged views of reference circles C and D from FIGS. 1A and 1B depict the inserts 20 and strap 30 received in the openings 18 of the sidewalls 14. FIG. 1C depicts the insert 20 and strap 30 as viewed from the interior of the container 10, and FIG. 1D depicts the insert 20 and strap 30 from the exterior of the container 10. As shown in FIGS. 1C and 1D, the insert 20 conforms to the opening 18 and engages the exterior and interior surfaces 14A and 14B. The insert 20 reinforces the sidewall 14 of the container 10 when the carrier 1 is lifted by the strap 30.

Meanwhile, the strap 30 extends from the interior to the exterior of the container 10 through the insert 20. The strap 30 includes ends 31 and 32 configured couple to a lifting device (e.g., crane, forklift, front loader, or other mechanism) for lifting the carrier 1 and contents disposed therein. When the lifting device lifts the carrier 1 via strap 30, the insert 20 reinforces the sidewall 14 of the container 10 and prevents the strap 30 from tearing through the sidewalls 14 of the container 10. For example, the insert 20 may distribute at least a portion of the lifting force from strap 30 along the portions of the sidewall 14 defining the opening 18 of the container 10. In another example, the insert 20 prevents the edges of the strap 30 from cutting through the sidewalls 14. Accordingly, the sidewall 14 is less likely to tear as compared to conventional carriers without an insert.

Referring to FIGS. 2A-2G, an insert 20 according to an embodiment is illustrated. The insert 20 includes a plate 201 having a front face 210, a rear face 220, a sidewall 230, and boss 240 defining an opening 241. The plate 201 has a circular shape and includes two flanges 212, 212' extending radially from the front face 210. The flanges 212, 212' are configured to engage the exterior surface 14A of the container 10. Thus, the flanges 212, 212' prevent the insert 20 from being pushed or pulled through the opening 18 and into the interior cavity 16 of the container 10. While the illustrated embodiment depicts two flanges 212, 212', in other embodiments, the plate 201 may contain any number of flanges that extend radially from the front face 210. In some implementations, the rear face 220 of the plate 201 may be parallel with a plane extending through the distal end 231 of a sidewall 230. That is, the plate 201 may have a thickness that extends from the front face 210 to the distal end 231 of the sidewall 230.

Figure 2C:
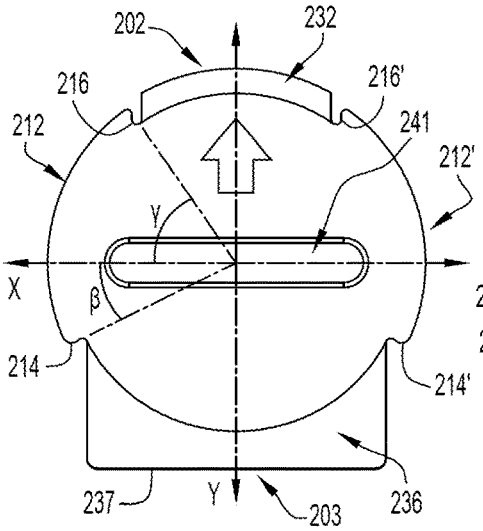
FIG. 2C is a front view of the insert of FIG. 2A

Each of the flanges 212, 212' include a flange bottom edge 214, 214' and flange top edge 216, 216', respectively. As shown in FIG. 2C, the flanges 212, 212' are vertically offset from a central horizontal axis X of the plate 201. That is, a majority of the flanges 212, 212' are disposed between the top 202 of the plate 201 and the horizontal axis X. Said in yet another way, for the first flange 212, a first angle $\beta$ between the flange bottom edge 214 and the horizontal axis is smaller than a second angled $\gamma$ between the flange top edge 216 and the horizontal axis X. The second flange 212' has substantially the same arrangement mirrored across a vertical axis Y.

Still referring to FIGS. 2A-2G, the sidewall 230 protrudes perpendicularly from the rear face 220 and extends around a perimeter of the plate 201. The sidewall 230 includes two lateral cutouts 238 at the intersections of the horizontal axis X and two tabs 232 and 236. The cutouts 238 are generally arc shaped and provide the insert 20 with a degree of flexibility about the horizontal axis X. That is, the cutouts 238 reduce the amount of force required to cause the insert 20 to bend about the horizontal axis X. Said in yet another way, an amount of torque/moment required to cause the insert 20 to bend about horizontal axis X is reduced by the cutouts 238.

Figure 3C:
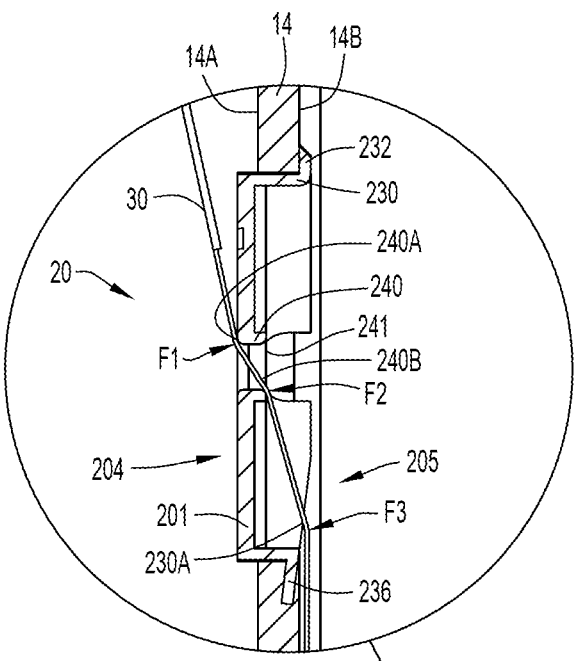
FIG. 3C is an enlarged view of reference circle E of FIG. 3B.

The tabs 232, 236 are configured to engage the interior surface 14B of the sidewall 14 of the container 10 (best shown in FIG. 3C). The tabs 232, 236 extend from a rear side 205 of the sidewall 230 at the top 202 and the bottom 203 of the insert 20, respectively. The top tab 232 extends vertically from the sidewall 230 and includes a beveled edge 234 at a top of the tab 232. The beveled edge 234 facilitates insertion of the insert 20 into the opening 18 of the sidewall 14 of the container 10. The bottom stabilizing tab 236 extends vertically downward at an angle $\theta$ oblique to the vertical axis Y. For example, the angle $\theta$ may be about five to ten degrees. In some implementations, the angle $\theta$ is about seven degrees. The angle $\theta$, however, may be of any other value. As discussed in greater detail below, the oblique angle $\theta$ of the stabilizing tab 236 facilitates resisting rotation of the insert 20 and/or a force applied by the strap 30 to the insert 20 during operation. A portion of the sidewall 230 extending from the rear face 220 to the stabilizing tab 236 follows the oblique angle $\theta$. Consequently, a length (extending between the rear face 220 and the stabilizing tab 236) of the portion of the sidewall 230 decreases as the stabilizing tab 236 extends down along the vertical axis Y to the bottom 203.

Figure 2D:
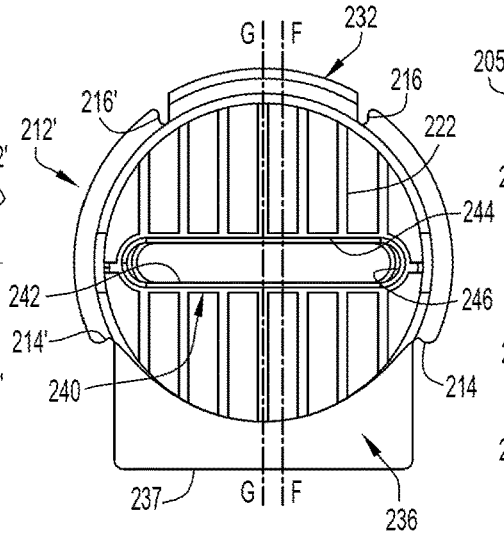
FIG. 2D is a rear view of the insert of FIG. 2A
Figure 2E:
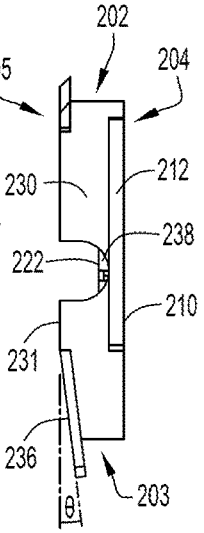
FIG. 2E is a side view of the insert of FIG. 2A.
Figure 2F:
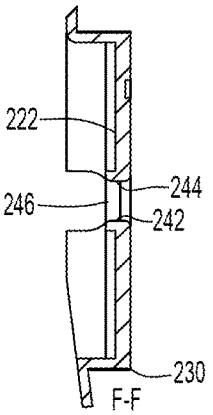
FIG. 2F is a cross-sectional view of the insert taken along line F-F of FIG. 2D.
Figure 2G:
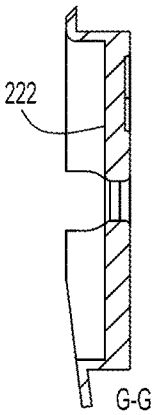
FIG. 2G is a cross-sectional view of the insert taken along line G-G of FIG. 2D.

As shown in FIGS. 2C and 2D, widths of the tabs 232 and 236 along the horizontal axis X correspond to gaps between the top edges 216 and 216' and the bottom edges 214 and 214' of the flanges 212 and 212', respectively. That is, the horizontal width of tab 232 is about the same as, or less than, the horizontal distance between the top edge 216 of flange 212 and the top edge 216' of flange 212'. And the horizontal width of tab 236 is about the same as, or less than, the horizontal distance between the bottom edge 214 of flange 212 and the bottom edge 214' of flange 212'. The top tab 232 is curved and generally follows the arcuate shape of the sidewall 230. The stabilizing tab 236 has a generally straight bottom edge 237 that is parallel to the horizontal axis X. In some implementations, the top tab 232 may be straight at the top 202 and/or the stabilizing tab 236 may have bottom edge 237 with an arcuate shape. While the illustrated embodiment depicts two tabs 232 and 236, in other embodiments, the plate 201 may contain any number of tabs that extend from the sidewall 230.

Still referring to FIGS. 2A-2G, the rear face 220 includes a plurality of ribs 222 and the boss 240. The ribs 222 protrude perpendicularly from the rear face 220 and extend in a direction parallel to vertical axis Y between the sidewall 230 and the boss 240. The ribs 222 help strengthen or increase the rigidity of the insert 20. The boss 240 includes a substantially straight bottom wall 242 and top wall 244 connected via substantially rounded, or curved, sidewalls 246. The boss 240 defines the opening 241 through the plate 201. The boss 240 is configured to guide the lifting strap 30 from the rear/interior side 205 through the opening 241 to a front/exterior side 204 of the insert. In some implementations, the ribs 222 may be omitted.

Figure 3D:
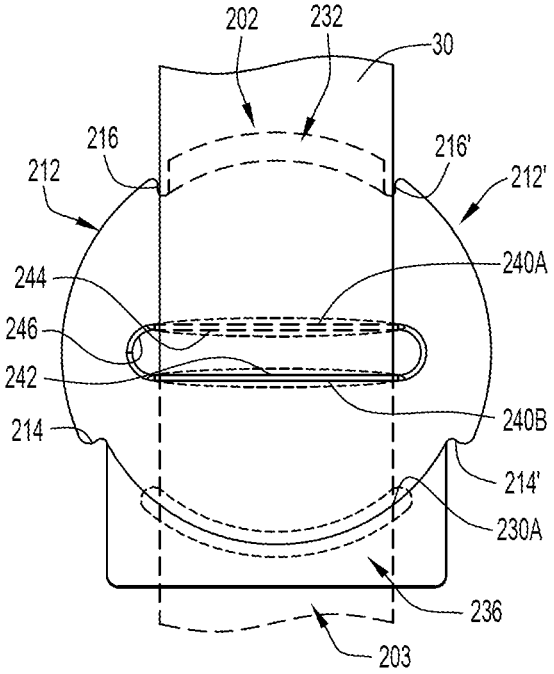
FIG. 3D is a front view of the insert of FIG. 3A where the strap is threaded through the insert.
Figure 3A:
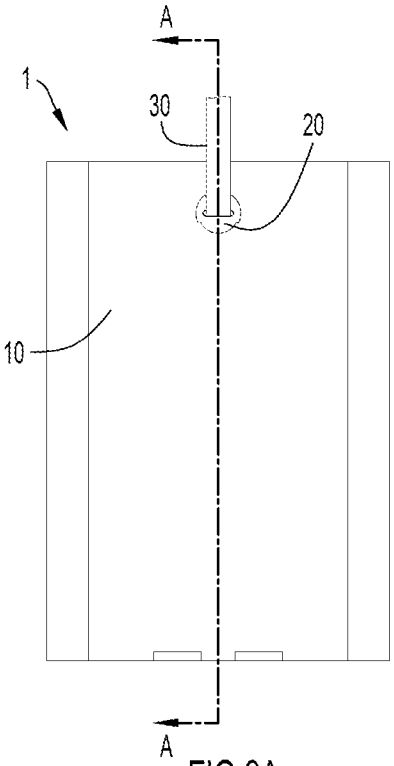
FIG. 3A is a front view of the bulk carrier and insert shown in FIG. 1A.
Figure 3B:
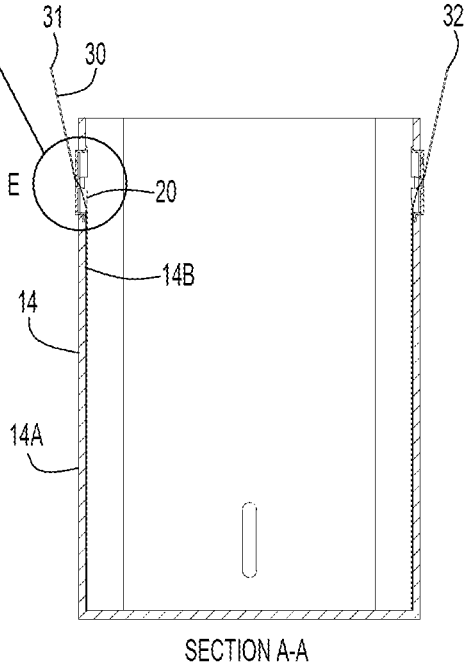
FIG. 3B is a cross-sectional view of the bulk carrier and insert taken along line A-A of FIG. 3A.

Now referring FIGS. 3A-3D, the carrier 1 is shown with the insert 20 disposed in the container 10 and the strap 30 received in the insert 20 under tension. When the ends 31 and 32 of the strap 30 are lifted, a lifting tension is applied through the strap 30 to the carrier 1. The strap 30 contacts the insert 20 along the boss 240 at contact regions 240A and 240B (as best shown in FIGS. 3C and 3D). Due to the lifting tension, the strap 30 applies first and second lateral forces F1 and F2 at contact regions 240A and 240B, respectively. The strap 30 further contacts the insert 20 along the sidewall 230 along contact region 230A along a width defined by the stabilizing tab 236. The strap 30 applies a third lateral force F3 at contact region 230A. As shown in FIG. 3C, the forces F1, F2, and F3 are not aligned and may have different magnitudes. That is, the forces F1, F2, and F3 applied by the strap 30 to the insert 20 may be unbalanced.

The lateral flanges 212 and 212', top tab 232, and stabilizing tab 236 distribute the forces F1, F2, and F3 applied by the strap 30 to the sidewall 14 of the container 10. The lateral flanges 212 and 212' are positioned on the plate 201, as described above, to substantially evenly distribute force F1, as well as any moment/torque generated by one or more forces F1, F2, and F3, to the container sidewall 14. For example, the flanges 212 and 212' are arranged on the plate 201 such that the contact region 240A is substantially between the flange top edges 216 and 216' and the flange bottom edges 214 and 214'. Biasing the lateral flanges 212 and 212' towards a top 202 of the insert 20 also helps resist moments/torques generated by forces F1, F2, and F3.

Additionally, top tab 232 and stabilizing tab 236 are positioned on the sidewall 230, as described above, to substantially evenly distribute forces F2 and F3, as well as any moments/torques generated by one or more forces F1, F2, and F3, to the container sidewall 14. For example, the stabilizing tab 236 has a generally rectangular shape having a larger surface area than the top tab 232. The shape and larger size of the stabilizing tab 236 provides a large surface area to substantially evenly distribute forces F2 and F3, as well as any moments/torques generated from one or more forces F1, F2, and F3 to the container sidewall 14. Moreover, the oblique angle θ of the stabilizing tab 236 elastically biases the stabilizing tab 236 against forces F2 and F3 and any moments/torques generated by one or more forces F1, F2, and F3.

Orienting the stabilizing tab 236 at the oblique angle θ also reduces the amount of force F1, F2, and F3 applied to the insert 20. The oblique angle θ of the stabilizing tab 236 decreases a length of the sidewall 230 between the stabilizing tab 236 and the rear face 220. That is, as the sidewall 230 extends from the top of the stabilizing tab 236 towards the bottom 203 of the insert 20, the length of the sidewall 230 decreases. Therefore, an angle from the vertical axis Y at which the strap 30 extends between contact regions 230A and 240B is reduced. Consequently, magnitudes of lateral forces F1, F2, and F3 transferred by the strap 30 to the insert 20 are also reduced.

Accordingly, the positions and sizes of the flanges 212 and 212', the top tab 232, and the stabilizing tab 236 are set to substantially evenly distribute the lateral forces F1, F2, and F3 from the strap 30 and moments/torques generated by the lateral forces F1, F2, and F3 to the container sidewall 14, while also preventing the insert 20 from rotating about the horizontal axis X. Consequently, the insert 20 reinforces the container sidewalls 14, and prevents the strap 30 from tearing the sidewall openings 18 during operation.

Furthermore, the stabilizing tab 236, in conjunction with the top tab 232 and the flanges 212 and 212' are configured to apply a clamping force to the sidewall 14 to thereby maintain a position and orientation of the insert 20 within the opening 18. For example, the oblique angle θ resiliently biases the stabilizing tab 236 towards the interior surface 14B. That is, the stabilizing tab 236 applies a biasing force to the interior surface 14B of the sidewall 14. To counter the biasing force from the stabilizing tab 236 and a moment along the insert 20 generated from the biasing force, the top tab 232 and the flanges 212 and 212' apply counter forces to the interior and exterior surfaces 14B and 14A, respectively. The counter forces from the flanges 212 and 212' and the top tab 232 and the biasing force from the stabilizing tab 236 cooperate to apply a clamping force to the sidewall 14. That is, the sidewall 14 is clamped between the flanges 212 and 212' and the tabs 232 and 236. The clamping force causes friction between the interior surface 14B and the tabs 232 and 236 and between the exterior surface 14A and the flanges 212 and 212'. The friction prevents the insert 20 from moving or rotating within the opening 18. Consequently, the insert 20 maintains a desired orientation within the opening 18 during construction and operation of the carrier 1.

The orientation of the insert 20 in conjunction with shape of the boss 240 and opening 241 prevent the strap 30 from cutting through the sidewall 14 of the container 10. For example, in the desired orientation (as shown in FIGS. 3A-3D), the bottom and top walls 242 and 244 of the boss 240 extend substantially horizontally and contact the strap 30 along contact regions 240B and 240A. Accordingly, contact regions 240A and 240B contact the strap 30 along a direction parallel to the horizontal axis X. Thus, the forces F1 and F2 from the strap 30 are substantially distributed along the contact regions 240A and 240B in the horizontal direction, and away from the sidewall 14.

Moreover, the curved sidewalls 246 guide the strap 30 towards a center of the contact regions 240A and 240B. For example, in response to the strap 30 sliding or otherwise moving horizontally away from one or more of the contact regions 240A and 240B, the curved sidewalls 246 are configured to guide the strap 30 back to the contact regions 240A and 240B. That is, the curved shape of the sidewalls 246 resists translation of the strap 30. Said yet another way, as the strap 30 moves further along the curved sidewall 246, the curvature of the curved sidewall 246 applies more counter force to the strap 30 towards the center of the contact regions 240A and 240B.

Additionally, the clamping force from the top tab 232, stabilizing tab 236, and flanges 212 and 212' resists any force, torque, or moment generated from movement of the strap 30. Consequently, the insert 20 maintains the desired orientation, and the boss 240 in turn maintains a position of the strap 30. Thus, the insert 20 prevents the strap 30 from contacting the sidewall 14 at the opening 18 and/or tearing the sidewall 14.

Figure 4C:
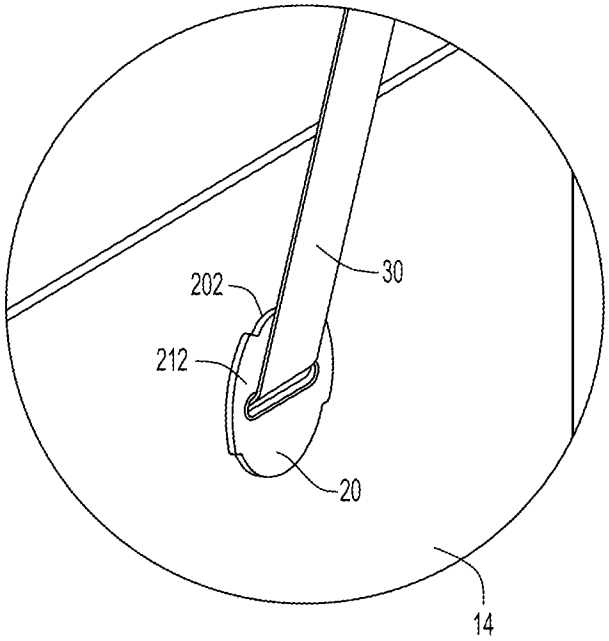
FIG. 4C is an enlarged view of reference circle BC of FIG. 4A with the insert engaging the container and threaded with a strap.
Figure 4B:
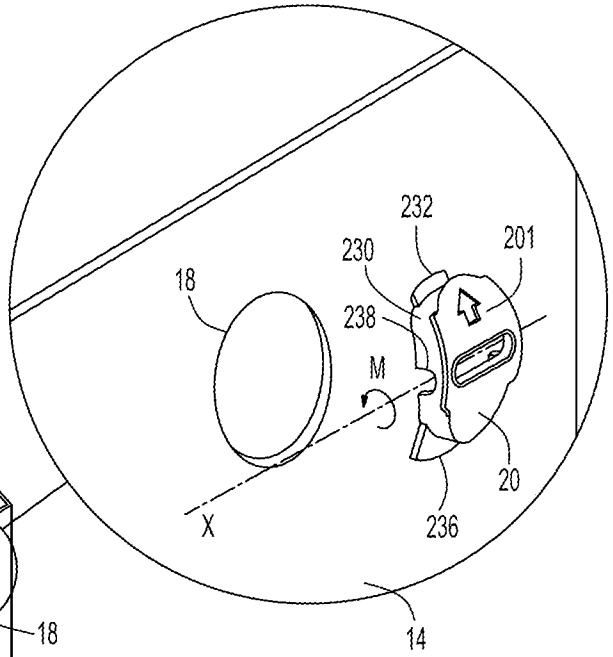
FIG. 4B is an enlarged view of reference circle BC of FIG. 4A with an insert in a torqued state.
Figure 4A:
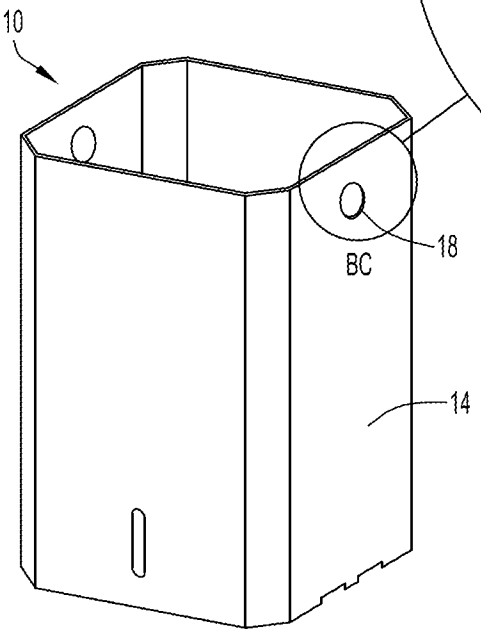
FIG. 4A is a perspective view of a container, according to an exemplary embodiment.

Now referring to FIGS. 4A-4C, a method of inserting the insert 20 into an opening 18 of the container sidewall 14 is illustrated. The insert 20 is bent along the horizontal axis X. That is, a torque M is applied to insert 20 about the horizontal axis X causing the plate 201 to resiliently flex such that the top tab 232 and the stabilizing tab 236 move towards each other. The lateral cutouts 238 may prevent the sidewall 230 from breaking under the stress/strain from the torque. In the torqued or bent state, the insert 20 is placed into the sidewall opening 18. For example, the stabilizing tab 236 is inserted into the sidewall opening 18, followed by the top tab 232. The beveled edge 234 of the top tab 232 facilitates insertion of the top tab 232 into the opening 18 by increasing the clearance between the top tab 232 and the opening 18.

Once inserted, the torque is released from the insert 20 and the insert 20 substantially returns to its equilibrium state. The top tab 232 and stabilizing tab 236 move away from each other and engage the inner surface 14B of the container sidewall 14 (as best shown in FIGS. 1C, 1D, and 3C). The stabilizing tab 236 applies a biasing force towards the inner surface 14B of the container sidewall 14. The biasing force may generate a moment/torque about a direction parallel to the horizontal axis X which may cause the top 202 of the insert 20 to be biased towards the interior side 205. The flanges 212 and 212' apply a force to the exterior surface 14A of the sidewall 14 to resist the biasing force and may also resist the moment/torque that may be generated by the biasing force (see FIG. 3C). Consequently, the insert 20 is held within the opening by the top tab 232, stabilizing tab 236, and flanges 212 and 212'.

After the insert 20 is positioned within the opening 18 of the sidewall 14, the lifting strap 30 is threaded through the insert opening 241. The contents (e.g., a bulk weld wire coil) may be placed inside the container 10. The strap 30 surrounds at least a portion of the contents. In some implementations, the strap 30 may be interleaved with at least a portion of the base 12 of the container 10. That is, the base 12 may comprise a plurality of layers and the strap 30 may be disposed between two layers of the plurality of layers before extending up to the openings 18. Accordingly, when a force is applied to the ends 31 and 32 of the strap 30, the container 10 and contents are supported by the strap 30.

Figure 5C:
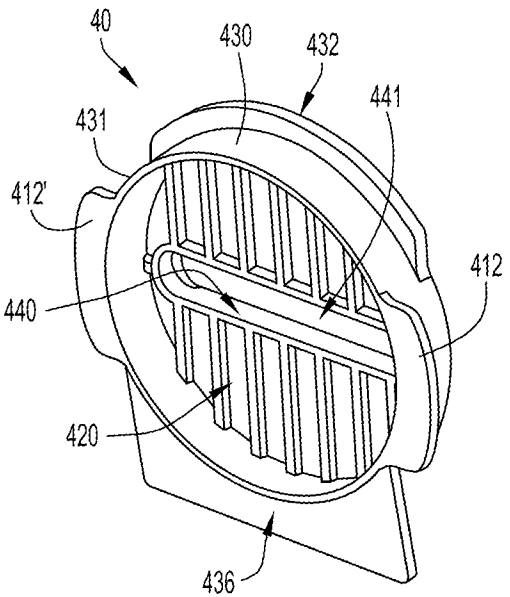
FIG. 5C is a rear perspective view of the insert of FIG. 5A.
Figure 5B:
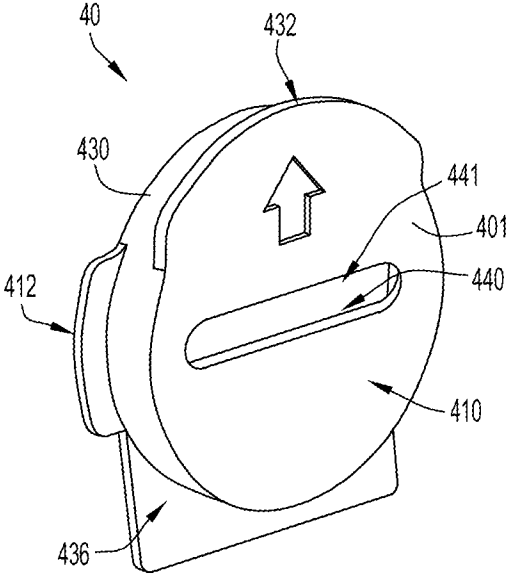
FIG. 5B is a front perspective view of the insert of FIG. 5A.
Figure 5A:
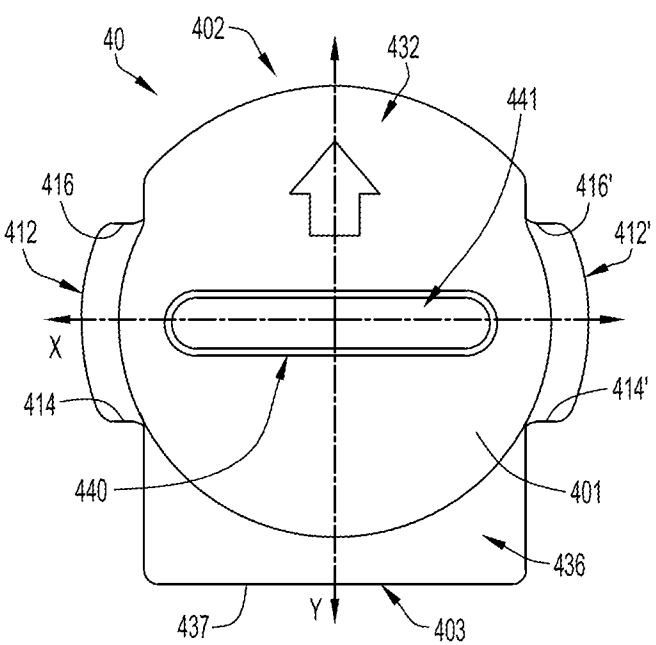
FIG. 5A is a front view of an insert according to a second embodiment.

Now referring to FIGS. 5A-5C, an insert 40 according to a second embodiment is illustrated. The insert 40 is substantially similar to the insert 20, however the tabs (e.g., top tab 432 and the flanges 412 and 412') of the insert 40 have a different arrangement from the tabs (e.g., top tab 232 and flanges 212 and 212') of the insert 20. For brevity, only the differences between insert 20 and insert 40 are discussed. For example, the insert 40 includes a plate 401 having a front face 410, a rear face 420, a sidewall 430, and boss 440 defining an opening 441. The plate 401 has a circular shape and includes, as best shown in FIGS. 5B and 5C, a sidewall 430 that protrudes perpendicularly from the rear face 420 and extends around a perimeter of the plate 401. Unlike sidewall 230, sidewall 430 does not have lateral cutouts. Instead, flanges 412, 412' extend laterally (i.e., in directions that are parallel to the front face 410 and the rear face 420) from a rear edge of the sidewall 430. When disposed within the opening 18 of the container 10, the flanges 412, 412' are configured to engage the interior surface 14B of the container 10. Thus, the flanges 412, 412' prevent the insert 40 from being pushed or pulled through the opening 18 and to an exterior of the container 10. While the illustrated embodiment depicts two flanges 412, 412', in other embodiments, the insert 40 may include any number of flanges that extend from the sidewall 430. In some implementations, the rear face 420 of the plate 401 may be parallel with a plane extending through the distal end 431 of the sidewall 430. That is, the plate 401 may have a thickness that extends from the front face 410 to the distal end 431 of the sidewall 430.

As further illustrated, the insert 40 includes a top tab 432 extending radially (i.e., in a direction parallel to the front face 410 and the rear face 420) from the plate 401, and a bottom stabilizing tab 436 extending radially downward from the rear edge of the sidewall 430. When disposed within the opening 18 of the container 10, the top tab 432 is configured to engage the exterior surface 14A of the container 10. Thus, the top tab 432 prevents the insert 40 from being pushed or pulled through the opening 18 and to the interior cavity 16 of the container 10.

Similar to the embodiment shown in FIGS. 2A-2G, the bottom stabilizing tab 436 extends vertically downward at an angle oblique to a vertical axis (i.e., the bottom stabilizing tab 436 extends in a direction that is offset from being parallel to the front face 410 and the rear face 420). For example, the angle may be about five to ten degrees. In some implementations, the angle is about seven degrees. The angle, however, may be of any value. The oblique angle of the stabilizing tab 436 facilitates resisting rotation of the insert 40 within the opening 18 of the container 10 and/or a force applied by the strap 30 to the insert 40 during operation. A portion of the sidewall 430 extending from the rear face 420 to the stabilizing tab 436 follows the oblique angle. Consequently, a length (extending between the rear face 420 and the stabilizing tab 436) of the portion of the sidewall 430 decreases as the stabilizing tab 436 extends down along the vertical axis to a bottom end 403 of the insert 40.

As shown in FIG. 5A, widths of the tabs 432 and 436 along a horizontal axis X correspond to gaps between the top edges 416 and 416' and the bottom edges 414 and 414' of the flanges 412 and 412', respectively. That is, the horizontal width of tab 432 is about the same as, or less than, the horizontal distance between the top edge 416 of flange 412 and the top edge 416' of flange 412'. And the horizontal width of tab 436 is about the same as, or less than, the horizontal distance between the bottom edge 414 of flange 412 and the bottom edge 414' of flange 412'. The top tab 432 is curved and generally follows the arcuate shape of the sidewall 430. The stabilizing tab 436 has a generally straight bottom edge 437 that is parallel to the horizontal axis X. In some implementations, the top tab 432 may be straight at a top 402 of the insert 40 and/or the stabilizing tab 436 may have a bottom edge 437 with an arcuate shape. While the illustrated embodiment depicts two tabs 432 and 436, in other embodiments, the insert 40 may contain any number of tabs.

Figure 6A:
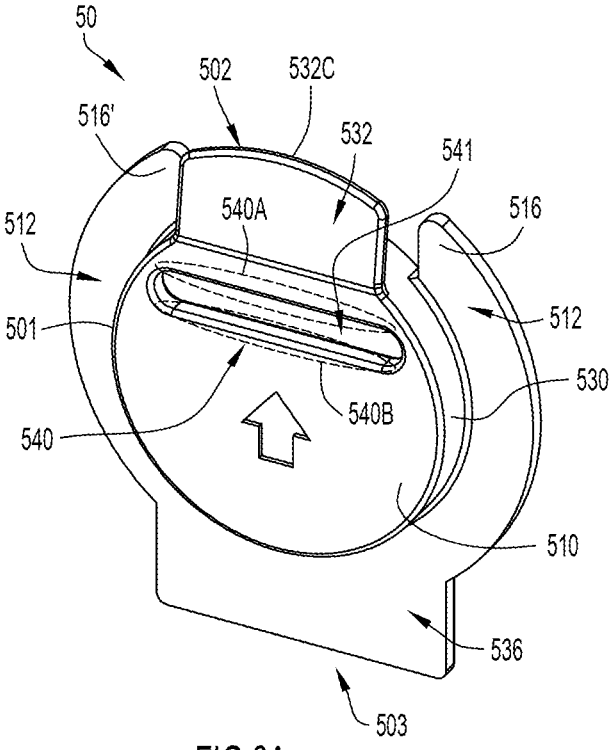
FIG. 6A is a front perspective view of an insert according to a third embodiment.
Figure 6B:
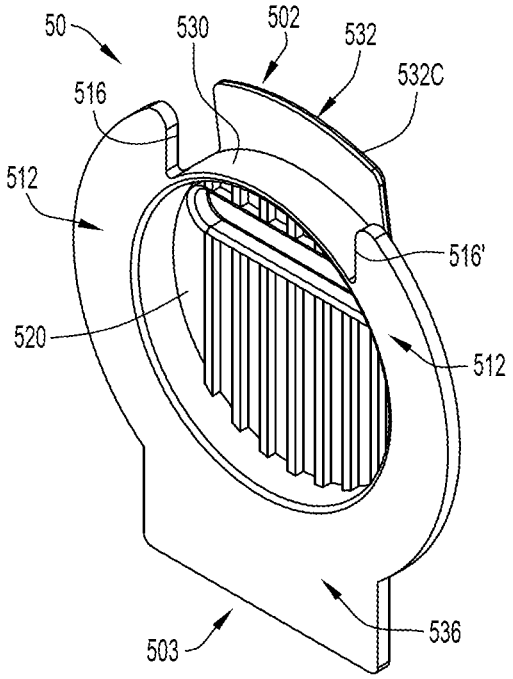
FIG. 6B is a rear perspective view of the insert of FIG. 6A

Now referring to FIGS. 6A-6D, an insert 50 according to a third embodiment is illustrated. The insert 50 is similar to the inserts 20, 40, however a top tab 532, a bottom tab 536, and a flange 512 of the insert 50 have a different arrangement from the tabs (e.g., top tabs 232, 432, bottom tabs 236, 436), and flanges (e.g., flanges 212, 212', 412, and 412') of the inserts 20, 40. For brevity, only the differences between the inserts 20, 40, and the insert 50 are discussed. For example, the insert 50 includes a plate 501 having a front face 510, a rear face 520, a sidewall 530, and boss 540 defining an opening 541 extending between the front face 510 and the rear face 520. The plate 501 has a circular shape and includes, as best shown in FIGS. 6A and 6B, a sidewall 530 that protrudes perpendicularly from the rear face 520 and extends around a perimeter of the plate 501. Unlike sidewall 230, sidewall 530 does not have lateral cutouts nor two distinct flanges 212, 212', 412, and 412'. Instead, a single flange 512 extends laterally (i.e., in directions that are parallel to the front face 510 and the rear face 520) from the sidewall 530. The single flange 512 extends circumferentially along a distal end 531 of the sidewall 530 from a first edge 532A of the top tab 532, around a bottom 503 of the insert 50, to a second end 532B of the top tab 532. In the embodiment shown in FIGS. 6A-6C, the flange 512 does not overlap with the top tab 532 and thus, defines gaps between the top tab 532 the flange 512. In other embodiments, the edges 516, 516' of the flange 512 may be aligned with the edges 532A, 532B, respectively, of the top tab 532, or may overlap the edges 532A, 532B, respectively, of the top tab 532. The flange 512 further includes a bottom tab 536 integrally extending downward from the bottom edge of the flange 512 towards a bottom 503 of the insert 50. In some implementations, the rear face 520 of the plate 501 may be parallel with a plane extending through the distal end 531 of the sidewall 530. That is, the plate 501 may have a thickness that extends from the front face 510 to the distal end 531 of the sidewall 530.

When disposed within the opening 18 of the container 10, the flange 512 and bottom tab 536 are configured to engage the interior surface 14B of the container 10. Thus, the flange 512 and bottom tab 536 prevent the insert 50 from being pushed or pulled through the opening 18 and to an exterior of the container 10. While the illustrated embodiment depicts one flange 512, in other embodiments, the insert 50 may include any number of flanges that extend from the sidewall 530 or plate 501.

As further illustrated, the top tab 532 extends radially upward from the plate 501 and the bottom tab 536 extending radially downward from the flange 512 towards the bottom 503 of the insert 50. When disposed within the opening 18 of the container 10, the top tab 532 is configured to engage the exterior surface 14A of the container 10 (see FIGS. 7A & 7B). Thus, the top tab 532 prevents the insert 50 from being pushed or pulled through the opening 18 and to the interior cavity 16 of the container 10. The arrangement between the insert 50 and the container 10 is discussed further below with reference to FIGS. 7A and 7B.

Still referring to FIGS. 6A-6D, the top tab 532 extends vertically upward at an angle θ oblique to a vertical axis Y (i.e., the top tab 532 extends in a direction that is offset, or askew, from being parallel to the front face 510 and the rear face 520). For example, the angle θ may be about five to ten degrees. In some implementations, the angle θ is about seven degrees. In other embodiments, the angle θ may be of any other value. The oblique angle θ of the top tab 532 facilitates resisting rotation of the insert 50 within the opening 18 of the container 10 and/or a force applied by the strap 30 to the insert 50 during operation.

Figure 6C:
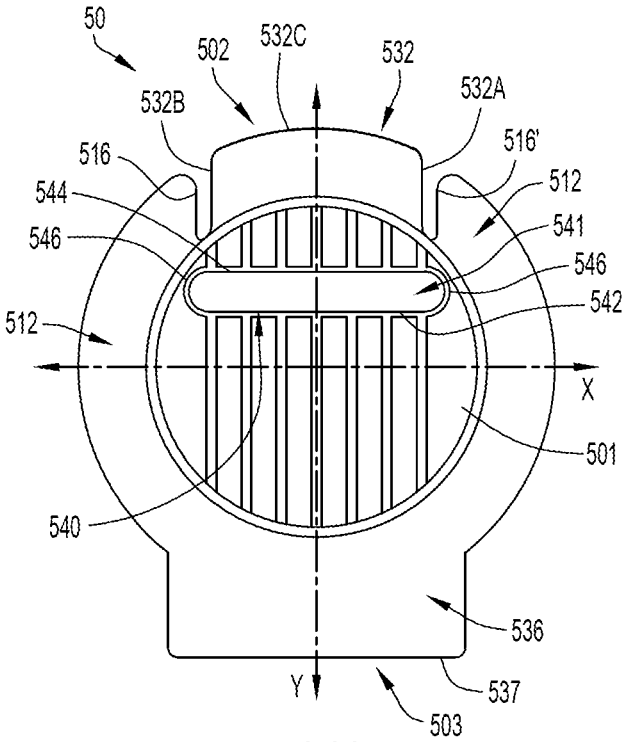
FIG. 6C is a front view of the insert of FIG. 6A.
Figure 6D:
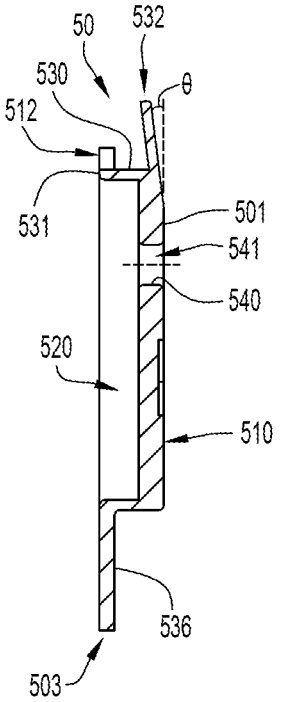
FIG. 6D is a cross-sectional side view of the insert of FIG. 6A.

As shown in FIG. 6C, the width of the top tab 532 (i.e., distance spanning between the first edge 532A and the second end 532B of the top tab 532) along a horizontal axis X corresponds to a gap between edges 516 and 516' of the flange 512. That is, the horizontal width of the top tab 532 is about the same as, or less than, the horizontal distance between the first edge 516 and second edge 516' of the flange 512. In other embodiments, the horizontal width of the top tab 532 may be greater than the horizontal distance between the first edge 516 and the second edge 516' of the flange 512. Additionally, the horizontal width of bottom tab 536 is about the same as, or greater than, the horizontal distance between the first edge 516 and second edge 516' of flange 512. In other embodiments, however, the horizontal width of the bottom tab 536 may be greater than the horizontal distance between the first edge 516 and the second edge 516' of the flange 512. The top edge 532C of the top tab 532 is curved and generally follows the arcuate shape of the sidewall 530 and flange 512. The bottom tab 536 has a generally straight bottom edge 537 that is parallel to the horizontal axis X. In some implementations, the top edge 532C of the top tab 532 may be straight and/or the bottom tab 536 may have a bottom edge 537 with an arcuate shape. While the illustrated embodiment depicts two tabs 532 and 536, in other embodiments, the insert 50 may contain any number of tabs.

As best shown in FIG. 6C, the opening 541 is offset towards the top 502 of the insert 50. For example, the opening 541 is disposed in the plate 501 between the top 502 of the insert 50 and the center of the plate 501. During use of the insert 50 in the container 10, the opening 541 is positioned and the flange 512 and tabs 532, 536 are sized to balance and distribute onto the sidewalls 14 of the container 10 the forces applied by a strap 30 extending through the opening 541.

Figures 7A, 7B:
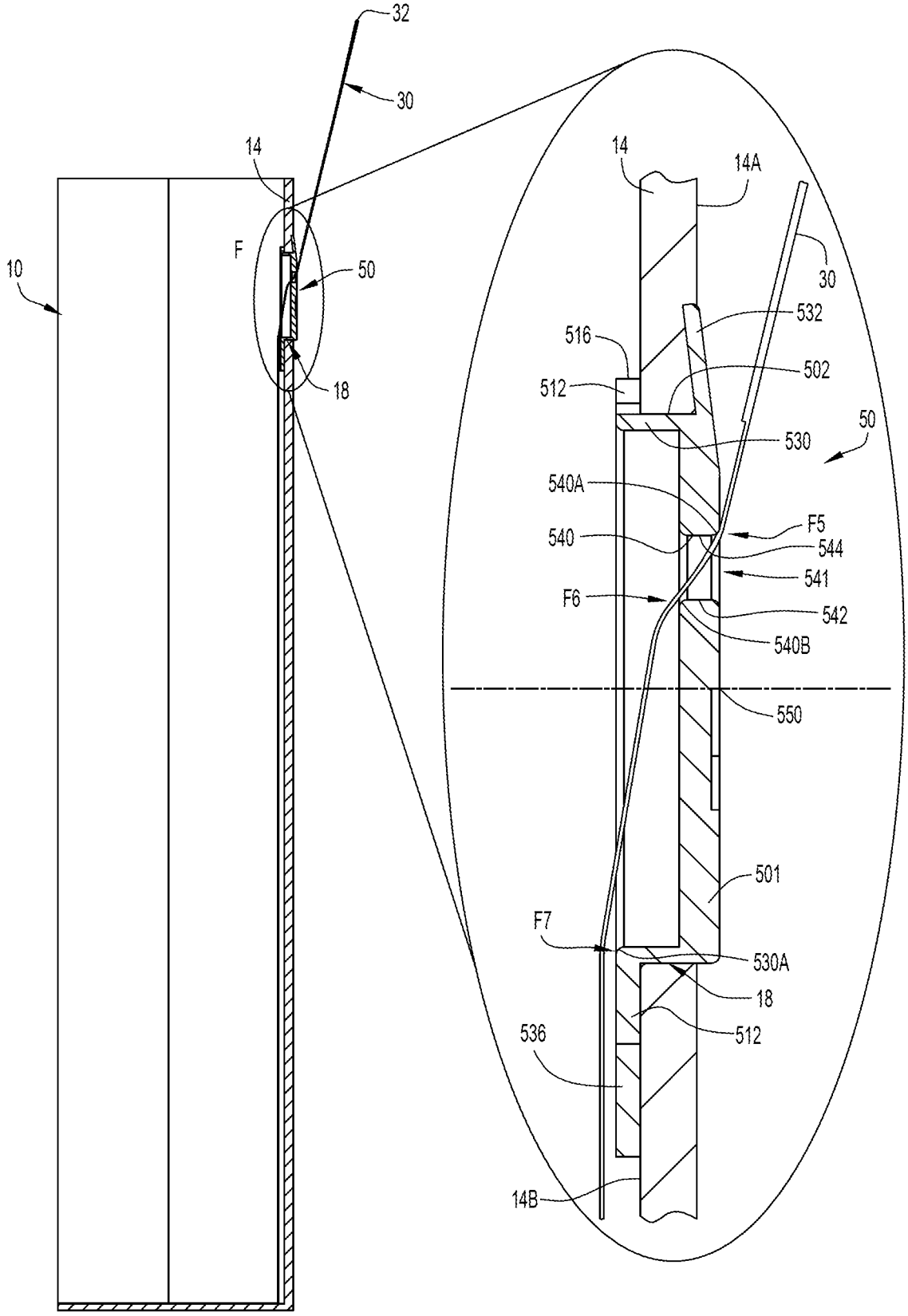
FIG. 7A is a cross-sectional view of the bulk carrier and the insert of FIG. 6A.
FIG. 7B is an enlarged view of reference circle F of FIG. 7A.

Now referring to FIGS. 7A and 7B, the insert 50 disposed in the container 10 of FIGS. 1A and 1B, with a strap 30 received in the insert 50 under tension. When the end 32 of the strap 30 is lifted, a lifting tension is applied through the strap 30 to the container 10. The strap 30 contacts the insert 50 along the boss 540 at contact regions 540A and 540B (as best shown in FIG. 7B). Due to the lifting tension, the strap 30 applies first and second lateral forces F5 and F6 at contact regions 540A and 540B, respectively. The strap 30 further contacts the insert 50 along the sidewall 530 at contact region 530A along a width defined by the bottom tab 536. The strap 30 applies a third lateral force F7 at contact region 530A. As shown in FIG. 7B, the forces F5, F6, and F7 are not aligned and may have different magnitudes. That is, the forces F5, F6, and F7 applied by the strap 30 to the insert 50 may be unbalanced.

The lateral flange 512, top tab 532, and bottom tab 536 distribute the forces F5, F6, and F7 applied by the strap 30 to the sidewall 14 of the container 10. The top tab 532 is disposed on the plate 501, as described above, to substantially evenly distribute force F5, as well as any moment/torque generated by one or more of the forces F5, F6, and F7, to the container sidewall 14. Moreover, the oblique angle θ of the top tab 532 elastically biases the top tab 532 opposite force F5 and any moments/torques generated by one or more of the forces F5, F6, and F7.

Additionally, the flange 512 and the bottom tab 536 are positioned on the insert 50, as described above, to substantially evenly distribute forces F6 and F7, as well as any moments/torques generated by one or more of the forces F5, F6, and F7, to the container sidewall 14. For example, the bottom tab 536 has a generally rectangular shape having a larger surface area than the top tab 532. The shape and larger size of the bottom tab 536 provides a large surface area to substantially evenly distribute forces F6 and F7, as well as any moments/torques generated from one or more forces F5, F6, and F7 to the container sidewall 14.

Meanwhile, the boss 540 is arranged in the plate 501 such that the opening 541 is substantially between a middle 550 of the plate 501 and edges 516, 516' of the flange 512. That is, the boss 540 and opening 541 are disposed in a top half of the plate 501, proximate to the top tab 532. Offsetting the boss 540 from the middle 550 and towards a top 502 of the plate 501 of the insert 50 also helps reduce and/or resist forces F5, F6, and F7 applied by the strap 30 and/or moments/torques generated by the forces F5, F6, and F7.

Accordingly, the positions and sizes of the flange 512, the top tab 532, and the bottom tab 536 are set to substantially evenly distribute to the container sidewall 14 the lateral forces F5, F6, and F7 from the strap 30 and any moments/torques generated by one or more of the lateral forces F5, F6, and F7, while also preventing the insert 50 from rotating about the horizontal axis X (shown in FIG. 6C). Additionally, the arrangement of the flange 512 and the tabs 532, 536 facilitates insertion of the insert 50 from an interior of the container 10 into the sidewall opening 18. Consequently, the insert 50 may be easily inserted into the sidewall opening 18 and reinforce the container sidewalls 14 to prevent the strap 30 from tearing the sidewall 14 during operation.

Furthermore, the top tab 532 and the flange 512 are configured to apply a clamping force to the sidewall 14 to thereby maintain a position and orientation of the insert 50 within the opening 18. For example, the oblique angle θ resiliently biases the top tab 532 towards the exterior surface 14A. That is, the top tab 532 applies a biasing force to the exterior surface 14A of the sidewall 14 at a location above the sidewall opening 18. To counter the biasing force from the top tab 532, the bottom tab 536 and the flange 512 apply counter forces to the interior surface 14B. The counter forces from the flange 512 and the biasing force from the stabilizing top tab 532 cooperate to apply a clamping force to the sidewall 14. That is, the sidewall 14 is clamped between the flange 512 and the top tab 532. The clamping force causes friction between the exterior surface 14A and the top tab 532, and between the interior surface 14B and the flange 512. The friction prevents the insert 50 from moving or rotating within the sidewall opening 18. Consequently, the insert 50 maintains a desired orientation within the sidewall opening 18 during construction and/or operation of the container 10.

The orientation of the insert 50 in conjunction with shape of the boss 540 and opening 541 prevent the strap 30 from cutting through the sidewall 14 of the container 10. For example, in the desired orientation (as shown in FIG. 7B), a bottom wall 542 and a top wall 544 of the boss 540 extend substantially horizontally and contact the strap 30 along contact regions 540B and 540A. Accordingly, contact regions 540A and 540B contact the strap 30 along a direction parallel to the horizontal axis X. Thus, the forces F5 and F6 from the strap 30 are substantially distributed along the contact regions 540A and 540B in the horizontal direction and prevents the strap from contacting sidewall 14 at and/or near the sidewall opening 18.

Moreover, curved sidewalls 546 of the boss 540 guide the strap 30 towards a center of the top wall 544 and the bottom wall 542. For example, in response to the strap 30 sliding or otherwise moving horizontally away from one or more of the contact regions 540A and 540B, the curved sidewalls 546 are configured to guide the strap 30 back to the contact regions 540A and 540B along the top and bottom walls 544, 542 (see FIGS. 6A and 6C). That is, the curved shape of the sidewalls 546 resists translation of the strap 30. Said yet another way, as the strap 30 moves further along the curved sidewall 546, the curvature of the curved sidewalls 546 applies more counter force to the strap 30 towards the center of the contact regions 240A and 240B.

Additionally, the clamping force from the top tab 532 and flange 512 resists any force, torque, or moment generated from movement of the strap 30. Consequently, the insert 50 maintains the desired orientation, and the boss 540 in turn maintains a position of the strap 30. Thus, the insert 50 prevents the strap 30 from contacting the sidewalls 14 at the sidewall opening 18 and/or tearing the sidewalls 14 (i.e., the insert 50 prevents the edges of the strap 30 from cutting through the sidewalls 14).

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

It is also to be understood that the carrier 1, container 10, the inserts 20, 40, 50, and the strap 30 described herein, or portions thereof, may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Reference may be made to the spatial relationships between various components and to the spatial orientation of various aspects of components as depicted in the attached drawings. However, as will be recognized by those skilled in the art after a complete reading of the present disclosure, the devices, components, members, apparatuses, etc. described herein may be positioned in any desired orientation. Thus, the use of terms such as "above," "below," "upper," "lower," "top," "bottom," "left," "right," "front," "rear," "side," "height," "length," "width," "interior," "exterior," "inner," "outer" or other similar terms merely describe points of reference and do not limit the present invention to any particular orientation or configuration. When used to describe a range of dimensions and/or other characteristics (e.g., time, pressure, temperature, distance, etc.) of an element, operations, conditions, etc. the phrase "between X and Y" represents a range that includes X and Y.

Further, the term "exemplary" is used herein to describe an example or illustration. Any embodiment described herein as exemplary is not to be construed as a preferred or advantageous embodiment, but rather as one example or illustration of a possible embodiment.

Further, the present disclosure may repeat reference numerals and/or letters in the various examples. This repetition is for the purpose of simplicity and clarity, and does not in itself dictate a relationship between the various embodiments and/or configurations discussed.

When used herein, the term "comprises" and its derivations (such as "comprising," "including," "containing," etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the similar terms, such as, but not limited to, "about," "around," and "substantially."

As used herein, unless expressly stated to the contrary, use of the phrase "at least one of," "one or more of," "and/or," and variations thereof are open-ended expressions that are both conjunctive and disjunctive in operation for any and all possible combination of the associated listed items. For example, each of the expressions "at least one of X, Y and Z," "at least one of X, Y or Z," "one or more of X, Y and Z," "one or more of X, Y or Z," and "X, Y and/or Z" can mean any of the following: 1) X, but not Y and not Z; 2) Y, but not X and not Z; 3) Z, but not X and not Y; 4) X and Y, but not Z; 5) X and Z, but not Y; 6) Y and Z, but not X; or 7) X, Y, and Z. Further as referred to herein, "at least one of" and "one or more of" can be represented using the "(s)" nomenclature (e.g., one or more element(s)).

Additionally, unless expressly stated to the contrary, the terms "first," "second," "third," etc., are intended to distinguish the particular nouns they modify (e.g., element, condition, node, module, activity, operation, etc.). Unless expressly stated to the contrary, the use of these terms is not intended to indicate any type of order, rank, importance, temporal sequence, or hierarchy of the modified noun. For example, "first X" and "second X" are intended to designate two "X" elements that are not necessarily limited by any order, rank, importance, temporal sequence, or hierarchy of the two elements.

The invention claimed is:

1. An insert comprising:

a plate having a front face and a rear face opposite the front face, the plate defining an opening extending between the front face and the rear face;

an oblique tab extending from the front face in a first direction; and a flange extending radially from the plate in a second direction.

2. The insert of claim 1, wherein an angle between the oblique tab and the front face is between 5 and 10 degrees.

3. The insert of claim 1, further comprising a boss surrounding the opening, the boss defined by a bottom wall, a top wall, and rounded sidewalls connecting the bottom wall and the top wall.

4. The insert of claim 3, wherein the boss defines the opening between the front face and the rear face.

5. The insert of claim 1, further comprising a sidewall extending around a perimeter of the plate and between the plate and the flange.

6. The insert of claim 1, further comprising a plurality of parallel reinforcing ribs disposed on the rear face.

7. The insert of claim 1, further comprising a second tab extending from a portion of the flange at a position that is opposite the oblique tab.

8. The insert of claim 1, wherein the opening is disposed in a top half of the plate proximate to the oblique tab.

9. A system comprising:

a carrier having a plurality of sidewalls;

at least one through-hole disposed in at least one sidewall of the plurality of sidewalls; and an insert disposed in the at least one through-hole, the insert comprising:

a plate having a front face and a rear face opposite the front face, the plate defining an opening extending between the front face and the rear face;

an oblique tab extending from the front face in a first direction; and at least one flange extending radially from the plate in a second direction.

10. The system of claim 9, wherein the oblique tab is configured to apply a first force to a first surface of the at least one sidewall.

11. The system of claim 10, wherein the at least one flange is configured to apply a second force to a second surface of the at least one sidewall, the second surface being opposite the first surface.

12. The system of claim 9, wherein an angle between the oblique tab and the front face is between 5 and 10 degrees.

13. The system of claim 9, wherein the plate further comprises:

a sidewall extending along a perimeter of the plate between the front face of the plate and the at least one flange.

14. The system of claim 9, wherein the plate further comprises:

a boss defining the opening, the boss comprising a bottom wall, a top wall, and rounded sidewalls connecting the bottom wall and the top wall.

15. The system of claim 9, wherein the opening is disposed in a top half of the plate proximate to the oblique tab.

* * * * *